US006325489B2

(12) United States Patent
Endo

(10) Patent No.: US 6,325,489 B2
(45) **Date of Patent: *Dec. 4, 2001**

(54) INK-JET PRINTING APPARATUS

(75) Inventor: Hironori Endo, Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/105,148

(22) Filed: Jun. 26, 1998

(30) Foreign Application Priority Data

Jul. 25, 1997 (JP) ..... 9-215991

(51) Int. Cl.[7] ..... B41J 2/21
(52) U.S. Cl. ..... 347/43; 347/40; 347/41
(58) Field of Search ..... 347/40, 41, 43, 347/12, 15, 47

(56) References Cited

U.S. PATENT DOCUMENTS

| | | | | |
|---|---|---|---|---|
| 4,593,295 | * | 6/1986 | Matsufuji et al. | 347/43 |
| 4,855,752 | * | 8/1989 | Bergstedt | 347/43 |
| 5,729,259 | * | 3/1998 | Gotoh et al. | 347/43 |
| 5,779,377 | * | 7/1998 | Kumai et al. | 347/41 |

FOREIGN PATENT DOCUMENTS

| | | | | |
|---|---|---|---|---|
| 6100996 | | 8/1994 | (EP) . | |
| 724962 | | 8/1996 | (EP) . | |
| 744706 | | 11/1996 | (EP) . | |
| 402047075 | * | 2/1990 | (JP) | 347/43 |
| 4-118250 | | 4/1992 | (JP) | B41J/2/21 |

* cited by examiner

*Primary Examiner*—N. Le
*Assistant Examiner*—Lamson Nguyen
(74) *Attorney, Agent, or Firm*—Sughrue, Mion, Zinn, Macpeak & Seas, PLLC

(57) ABSTRACT

A recording head is so designed that a plurality of nozzle openings for each of the nozzle opening arrays are arranged at intervals of at least four or more print-pitches in the sub-scanning direction, that the nozzle opening arrays are divided into at least two groups, that the nozzle opening arrays belonging to each of the groups are positioned along the same line in the main scanning direction, and that the groups are shifted away from each other at least two print-pitches in the sub-scanning direction. Dots of different groups do not contact each other during printing, and when printing for one scan line is completed, a recording medium is fed a number of print-pitches that corresponds to the nozzle opening count, so that a paper feeding distance error can be constant.

13 Claims, 10 Drawing Sheets

S = n

S = n + 1

S = n + 2

S = n + 3

S = n + 4

S = n

S = n + 1

S = n + 2

S = n + 3

S = n + 4

S = n + 5

S = n + 6

S = n + 7

S = n + 8

INK-JET PRINTING APPARATUS

BACKGROUND OF THE INVENTION

The present invention relates to a color mixture prevention technique for an ink-jet printing apparatus that ejects ink droplets of differently colors through a plurality of nozzle opening arrays to provide color printing.

An ink-jet printing apparatus for color printing is so designed that an ink-jet head having a plurality of nozzle opening arrays, generally four or more arrays, through which ink droplets of different colors independently eject is mounted on a carriage. The ink-jet printing apparatus repeats the following processing: while the recording head is moving in the main scanning direction, ink droplets corresponding to print data are ejected, and when the data for one scanning is completed, the print position is shifted a distance equivalent to a predetermined pitch.

Since the color printing quality is greatly affected by the accuracy at which individual dots that constitute pixels are positioned, in the printing apparatus, nozzle openings 2 of each nozzle opening array, through which ink droplets are at least ejected during color printing, are aligned for individual colors along the same scanning lines, as is shown in FIG. 10A, so that a relative accuracy for the positioning of dots that are formed on a recording medium is ensured.

However, since dots of different colors are printed during color printing, the individual ink colors tend to be mixed together.

To resolve this problem, Japanese Unexamined Patent Publication No. Hei 4-118250 proposes a printing method, for an ink-jet printing apparatus, as disclosed in FIG. 10B, whereby nozzle opening arrays C, M, Y and K are shifted so there is one print-pitch between them and so there are four print-pitches between their nozzle openings 2, through which different color ink droplets are ejected, and whereby, during one main scan, to prevent the color-mixing of dots of different- colors are not formed on the same line at the same timing.

However, since during the course of one scan, dots that form one line contact dots in an adjacent line, some color-mixing occurs, and two paper feeding types are required: paper feeding for forming on each print line dots having different colors, and paper feeding by which a printing area is changed by advancing the paper a distance that is equivalent to the printing height of the recording head. Therefore, a paper feeding distance error is varied that cause banding and blank areas, and as a result, an improvement in print quality can not be expected.

SUMMARY OF THE INVENTION

To resolve such shortcomings, it is one objective of the present invention to provide an ink-jet printing apparatus that does not cause banding or produce blank areas, and that high quality color printing can be performed by preventing the mixing of different colors.

The foregoing and other objects can be achieved by a provision of an ink-jet printing apparatus which, according to the present invention, includes an ink-jet recording head which moves in a main scanning direction, the recording head having a plurality of nozzle opening arrays, through which different color ink droplets are independently ejected, are arranged in the main scanning direction, and that feeds a recording medium in a sub-scanning direction when one scan is completed, wherein the recording head is so designed that a plurality of nozzle openings for each of the nozzle opening arrays are arranged at intervals of at least four or more print-pitches in the sub-scanning direction, that the nozzle opening arrays are divided into at least two groups, that the nozzle opening arrays belonging to each of the groups are positioned along the same line in the main scanning direction, and that the groups are shifted away from each other at least two print-pitches in the sub-scanning direction; and wherein the recording head uses an interlaced system to print color data.

Dots of different groups do not contact each other before the ink is completely dried, and when printing for one scan line is completed, a recording medium is fed a number of print-pitches that corresponds to the nozzle opening count, so that a paper feeding distance error can be constant.

DESCRIPTION OF THE PREFERRED EMBODIMENTS

The present invention will be described in detail during the course of an explanation of the embodiments illustrated by the drawings.

Figure 1:
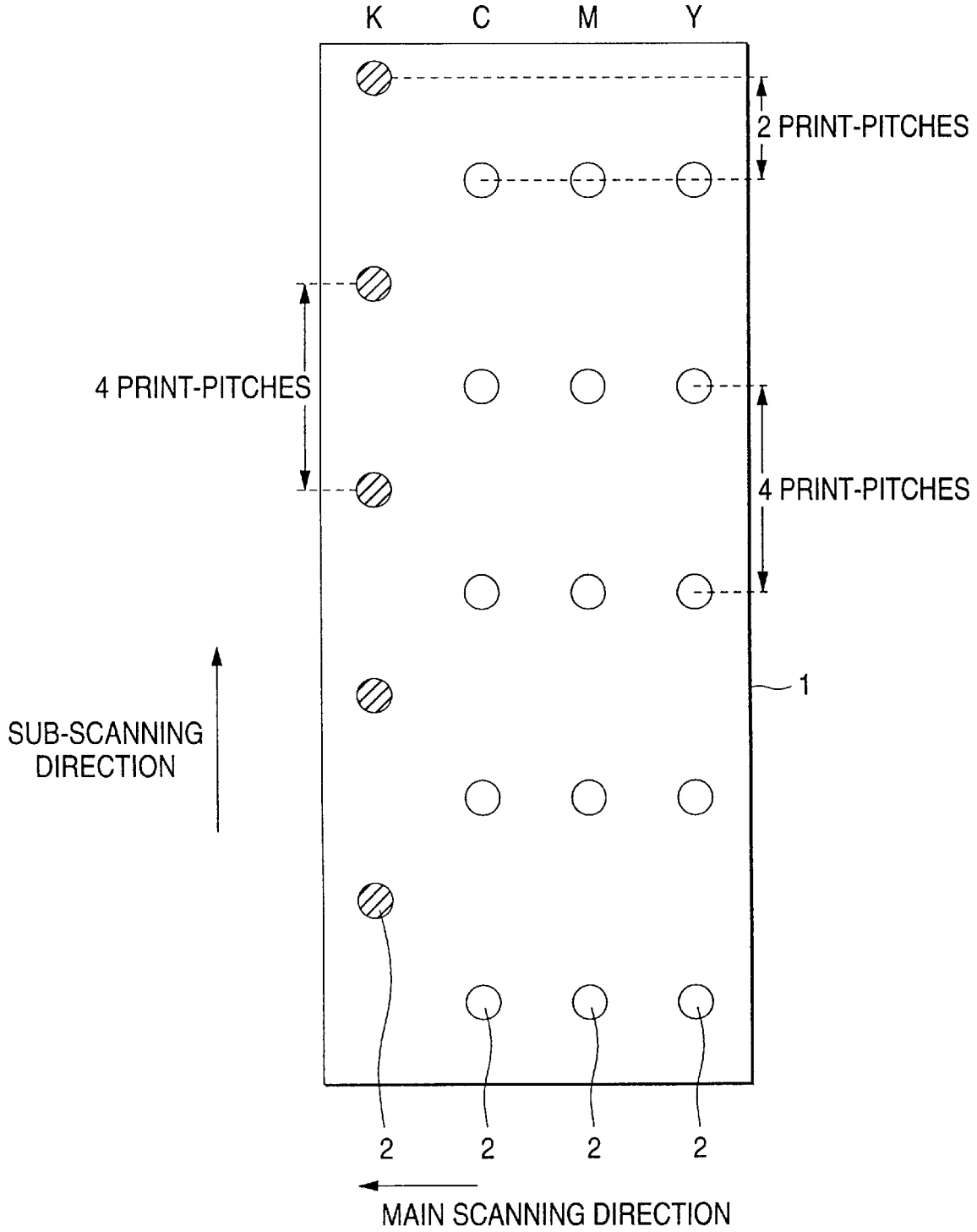
FIG. 1 is a diagram illustrating an arrangement of nozzle openings of an ink-jet recording head according to a first embodiment of the present invention.

FIG. 1 shows an arrangement of nozzle opening arrays of an ink-jet recording head according to a first embodiment of the present invention. Reference symbols K, C, M and Y denote nozzle opening arrays in a recording head 1 for independently ejecting black, cyan, magenta and yellow ink droplets, respectively. The nozzle opening arrays are arranged at the intervals equivalent to the print-pitch count for the nozzle openings 2, i.e., an interval of four print-pitches in this embodiment. In addition, the nozzle openings 2, the number of which is a relative prime number to the pitch count for the nozzle openings 2, five in this embodiment, are aligned in the sub-scanning direction, i.e., in the paper feeding direction.

For the arrays C, M and Y, the nozzle openings that eject cyan, magenta and yellow ink droplets, respectively, are arranged in rows that are shifted two print-pitches in sub-scanning direction away from the nozzle opening array K that ejects black ink droplets.

Figure 2:
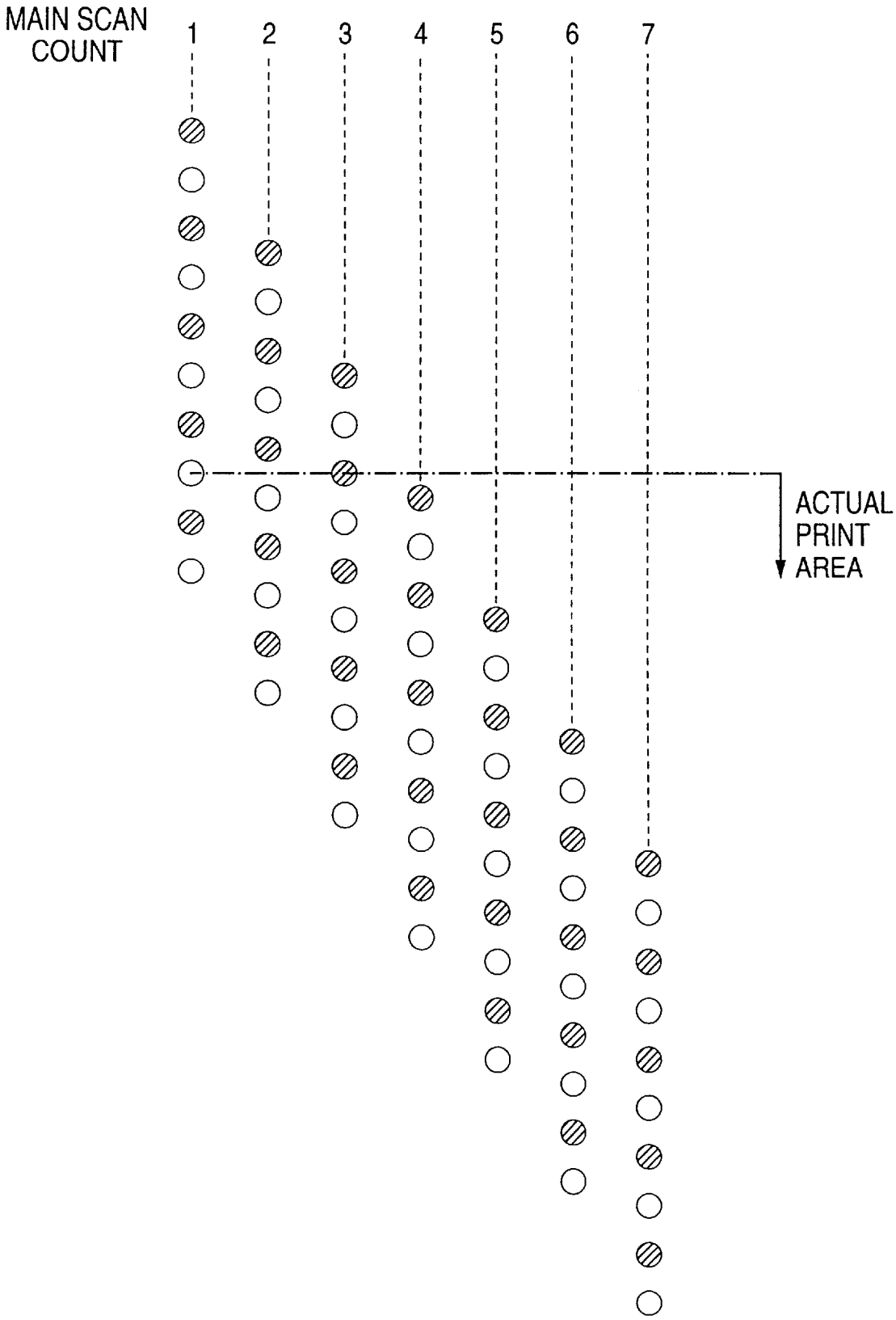
FIG. 2 is a diagram showing the printing form of the present invention for each main scanning process.
Figure 3A:
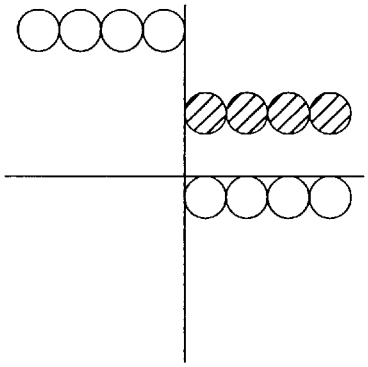
FIGS. 3A to 3E are diagrams showing a transient change until the vertical and horizontal boundaries are formed between the first group dots and the second group dots that are printed in the above printing form.
Figure 3B:
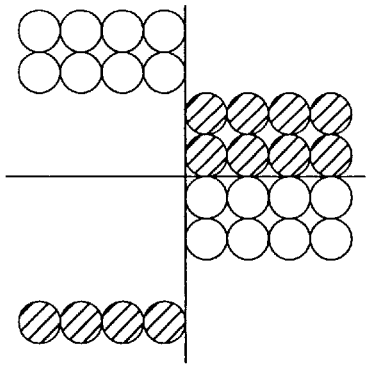
Figure 3C:
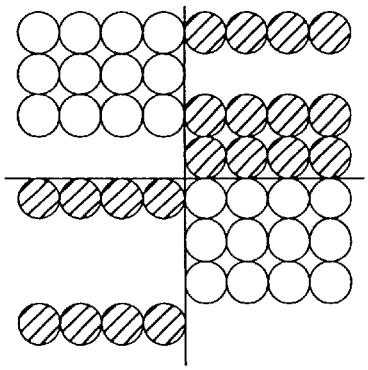
Figure 3D:
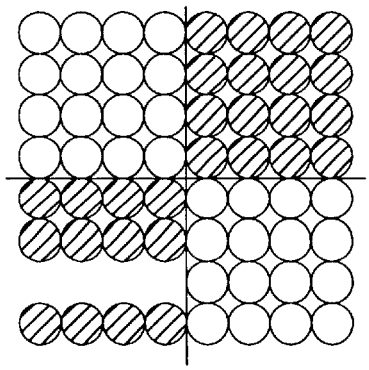
Figure 3E:
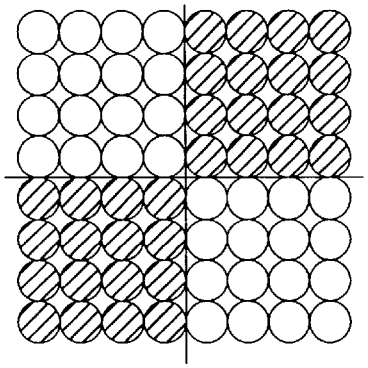

When the thus structured recording head 1 is moved at a constant speed in the main scanning direction, i.e., in the direction of the width of the recording medium, and at the same time a drive signal is transmitted to pressure generation means, such as a piezoelectric vibrator or a Joule heat generator that are independently provided in a pressure generation chamber communicating with the nozzle openings 2, during the first main scanning, as is shown in FIG. 2, black dots (hatched circles ● in FIG. 2), the first group are printed in a line that extends in the main scanning direction, and cyan, magenta and yellow dots (unhatched circles ○ in FIG. 2), the second group, are printed at a distance equivalent to two print-pitches from the line formed by the black dots.

Therefore, during one scan, dots made with black ink, which is the first group, do not contact dots made with other colored inks, which belong to the second group, the mixing of the black ink, which drastically affects the tones of the other colors when it is mixed with them, with other colors can be completely prevented, so that dots of cyan, magenta and yellow can be printed clearly. Although the cyan, magenta and yellow dots are printed on the same scan line, on the whole, the effect produced by mixing of these ink colors is not critical, when compared with the deterioration of image quality that occurs when the colors are mixed with black ink.

When the printing for one scanning line is completed and the recording medium is fed the number of print-pitches that corresponds to the nozzle opening count, i.e., five print-pitches, to repeat the printing in the same manner, dots of inks of the first and the second groups are formed between the dots that were printed at two print-pitch intervals during the first scan.

By the time the printing of the second scanning line is initiated, the dots that were formed for the first scanning line are dry, so that ink smudging occasioned by the formation of succeeding dots not occur. Therefore, even when dots of colored inks in the second group are formed adjacent to black dots that were printed during the first scan, or when black dots are printed adjacent to dots of colored inks in the second group that were deposited during the first scan, even though the boundaries of the dots are overlapped, the inks of the black dots and of the other colored dots do not mix.

The printing is thereafter continued with the recording medium being fed at constant five print-pitches, which is a number equal to that of the nozzle openings in each nozzle opening array. Since the paper feeding is performed at the constant pitch, a constant paper feeding distance error can be maintained, and printing without banding or blank areas can be provided.

With this printing method, at the boundaries indicated by the crossed lines shown in FIG. 3A to 3E, the dots printed with black ink, which constitutes the first group, do not contact dots printed with other colored inks, which constitute the second group, until a period of time equivalent to at least one scan period has elapsed. Thus, the mixing of the ink in black dots with the inks of the other colored dots does not occur along the vertical boundary and the horizontal boundary (S in FIGS. 3A to 3E denotes the number of scans).

Figure 4:
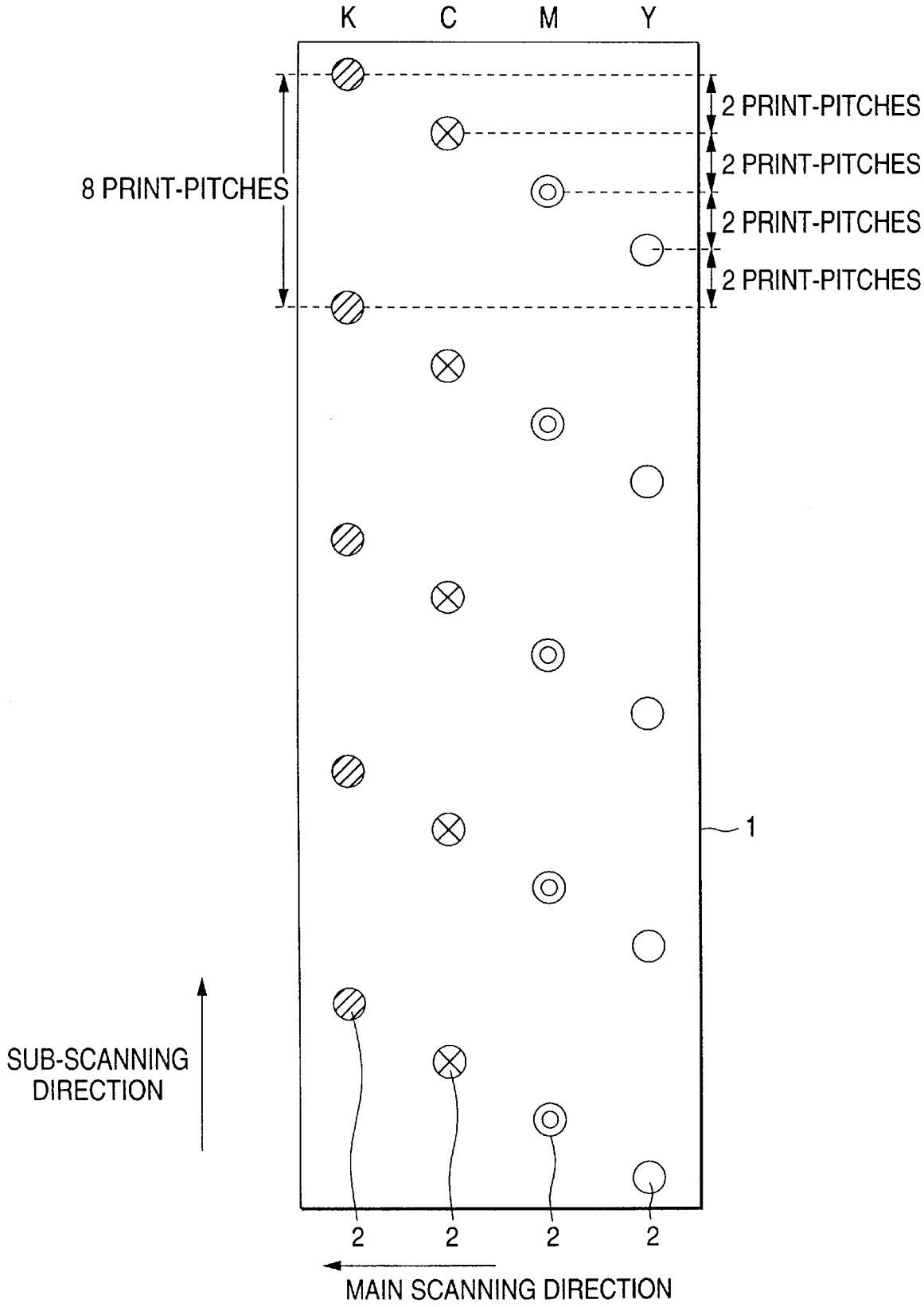
FIG. 4 is a diagram illustrating an arrangement of nozzle openings for a recording head according to a second embodiment of the present invention.

FIG. 4 shows the arrangement for the nozzle opening arrays of an ink-jet printing apparatus according to a second embodiment of the present invention. Reference symbols K, C, M and Y denote arrays of nozzle opening in a recording head 1 that independently eject black, cyan, magenta and yellow ink droplets. The nozzle opening arrays are arranged at intervals equivalent in number to the print-pitches used for arranging the nozzle openings 2, intervals of eight print-pitches in this embodiment. And the nozzle openings 2, the number of which is a relative prime number, 8 in this embodiment, to the print-pitch count used for arranging the nozzle openings 2, i.e., five nozzle openings 2, are so arranged that they are shifted two print-pitches away from each other in the sub-scanning direction.

Figure 5:
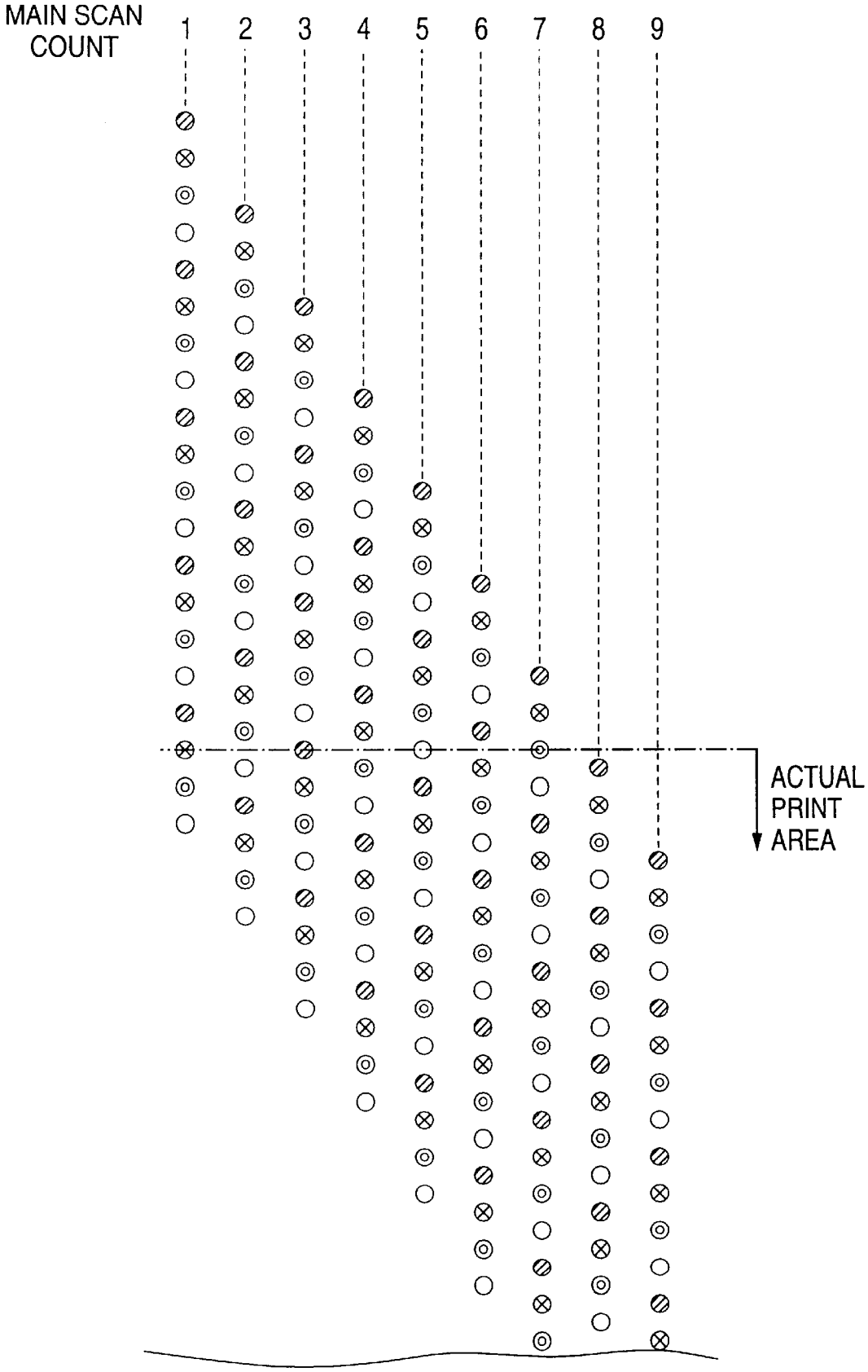
FIG. 5 is a diagram showing the printing form of the present invention for each main scanning process.
Figure 6A:
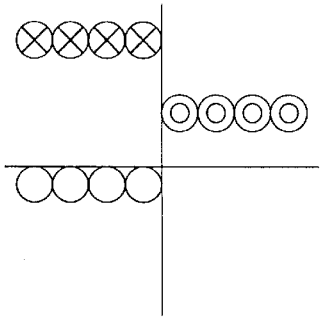
FIGS. 6A to 6I are diagrams showing a transient change until the vertical and horizontal boundaries are formed between the first to the fourth group dots that are printed in the above printing form.
Figure 6B:
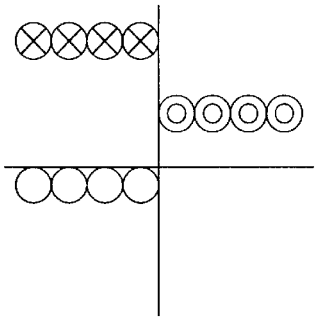
Figure 6C:
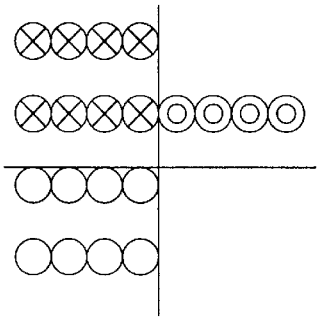
Figure 6D:
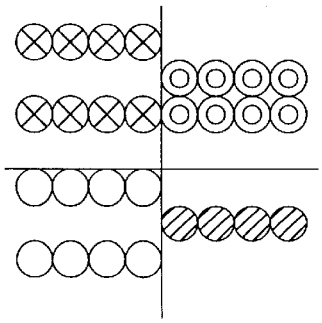
Figure 6E:
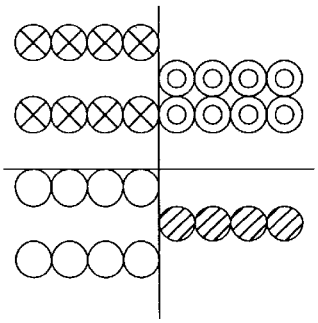
Figure 6F:
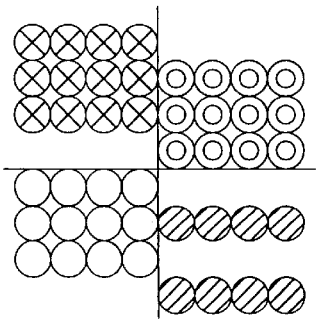
Figure 6G:
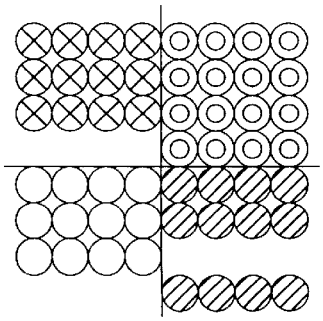
Figure 6H:
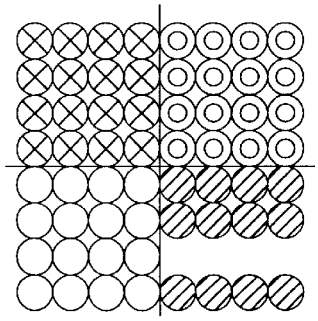
Figure 6I:
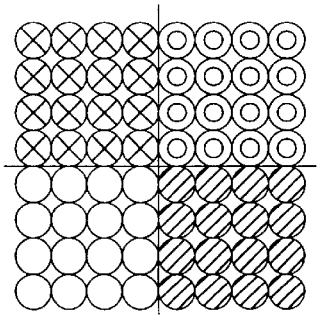

When the printing is initiated while the thus structured recording head 1 is being moved, by a carriage, at a constant speed in the main scanning direction, as is shown in FIG. 5, at the first main scanning, black dots (hatched ●s in FIG. 5) that belong to a first group, cyan dots (ⓧs) that belong to a second group, magenta dots (◎s) that belong to a third group and yellow dots (○s) that belong to a fourth group are printed along lines that are separated from each other by two print-pitches in the sub-scanning direction.

As a result, the mixing of the colored inks, to include black, can be completely prevented, and color ink dots can be printed clearly.

When the printing for one scanning line is completed and the recording medium is fed the number of print-pitches that corresponds to the nozzle opening count, i.e., five print-pitches, to repeat the printing in the same manner using the interlaced method, dots are formed between the dots that were printed at two print-pitch intervals during the first scan.

By the time the printing of the second scanning line is initiated, the dots that were formed for the first scanning line are so dry that ink is not smudged when it is contacted by the dots that are printed next. Therefore, when dots of individual colored inks are formed adjacent to dots that were printed during the first scan, even though the boundaries of the dots partially overlap, mixing of the colored inks does not occur.

The printing is thereafter continued while the recording medium is fed by constant five print-pitches, a count that is equal to that of the nozzle openings. Since the paper feeding is performed at a constant print-pitch, a paper feeding distance error can be constant, and printing without banding or the production of blank areas can be provided.

With this printing method, at the boundaries indicated by the crossed lines shown in FIGS. 6A to 6I, since the colored ink dots contact others only after one scan period has elapsed, no mixing of the ink in the black dots and the ink in the other colored dots occurs along the vertical boundary and the horizontal boundary (S in FIG. 6 denotes the number of scans).

Figure 7A:
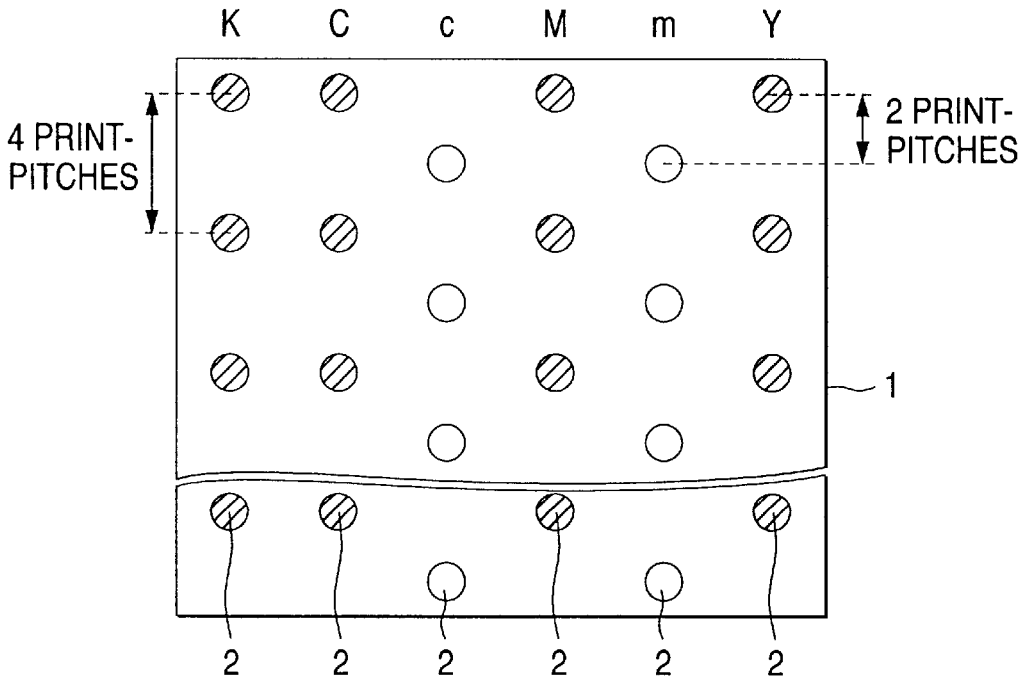
FIGS. 7A and 7B are diagrams illustrating example arrangements of nozzle openings of the recording head of the present invention.
Figure 7B:
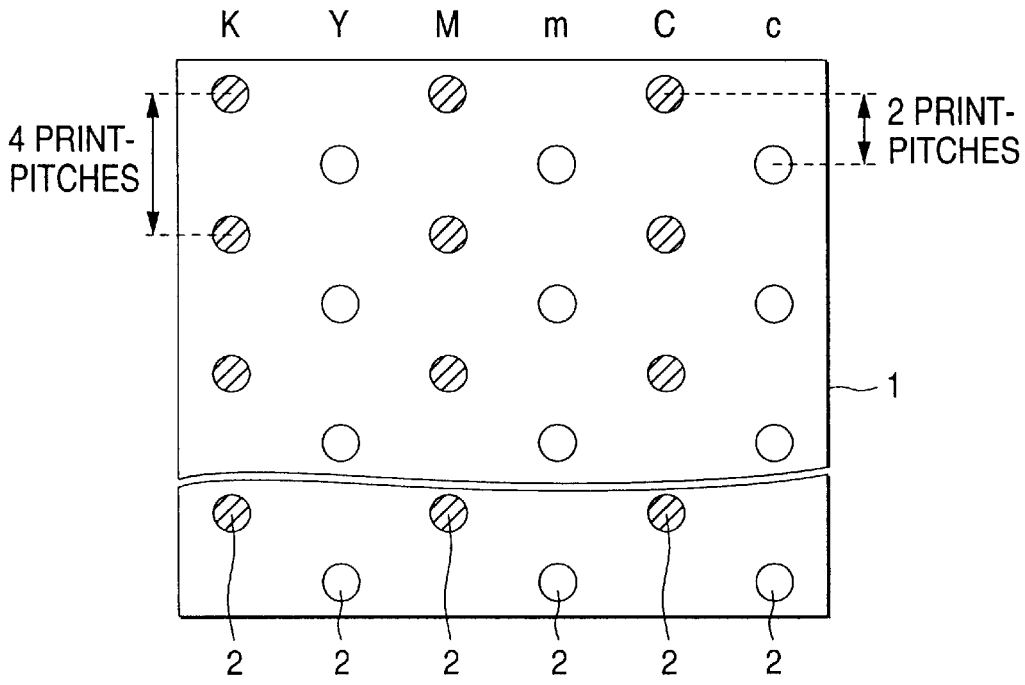

FIGS. 7A and 7B show a third embodiment of the present invention that is appropriate for six-color printing using dark and light colored inks. Reference symbols K, C, M and Y denote arrays of nozzle openings in a recording head 1 that independently eject black, dark cyan, dark magenta and yellow ink droplets. Reference symbols c and m denote arrays of nozzle openings in the recording head 1 that independently eject light cyan and light magenta ink droplets. In this embodiment, the nozzle opening arrays are arranged at intervals of four print-pitches, and nozzle openings 2, the number of which is a relative prime number to the pitch count for the nozzle opening arrangement, 63 in this embodiment, are arranged in the sub-scanning direction.

The arrays K, C, M and Y, of the nozzle openings that respectively eject black, dark cyan, dark magenta and yellow ink droplets, constitute the first group, and the arrays c and m, of the nozzle openings that respectively eject light cyan and light magenta ink droplets, constitute the second group. The nozzle openings of the individual arrays of the first and the second groups are shifted two print-pitches in the sub-scanning direction.

In this embodiment, as well as in the first embodiment, when printing is initiated as the recording head 1 is being moved, by the carriage, at a constant speed in the main scanning direction, during the first main scan the dots (hatched ●s in FIGS. 7A and 7B) are formed along individual lines using black, dark cyan, dark magenta and yellow ink droplets, and dots (○s) for the light cyan and light magenta colors, which belong to the second group, are separately printed two print-pitches away from the dot line formed by the first group.

As a result, the mixing of the inks used for dark cyan, dark magenta and yellow dots with light cyan and light magenta dots can be completely prevented, and light cyan and light magenta dots that contribute greatly to the enhancement of the color tones can be printed clearly. Although the light cyan and light magenta dots are printed on the same line, the image quality is very little affected by a change in color, when compared with when these inks are mixed with a black, dark cyan, dark magenta or yellow ink that has a high color density.

When printing for one scan line is completed and the recording medium then is fed by the number of print-pitches corresponding to that of the nozzle openings, i.e., 63 print-pitches, to repeat the printing using the interlaced system, dots are formed between the dots that were printed at two print-pitch intervals during the first scan.

By the time the printing of the second scanning line is initiated, the dots that were formed for the first scanning line are dry, and there is no smudging of the ink used to print the dots. Therefore, when dots printed with the light inks of the second group are placed adjacent to dots printed with the dark inks of the first group during the first scan, or when dots of dark ink are placed adjacent to dots printed with light ink during the first scan, even though the boundaries of dots are overlapped, the mixing of colors does not occur, and the light inks used for dots are not mixed with the dark colored inks.

Since the printing is performed while the recording medium is being fed by constant 63 print-pitches that correspond in number to nozzle openings, a constant 63 print-pitch paper feeding is ensured, a constant paper feeding distance error can be maintained, and printing can be performed without causing banding or producing blank areas at the boundaries of a single scanning area.

With this printing method, as for the boundaries indicated by cross lines as well as shown in FIG. 3, since the dark color ink dots (corresponding to hatched ● in FIG. 3) of the first group contact the light ink dots (corresponding to ○ in FIG. 3) of the second group after at least the one scanning period has elapsed, the mixing of the light ink dots and the dark ink dots does not occur along the vertical boundary and the horizontal boundary.

In the above embodiment, an explanation will be given in order to prevent the mixture of black, dark cyan, dark magenta and yellow ink dots with light cyan and light magenta ink dots. To prevent the mixture of black, dark cyan, dark magenta ink dots with light cyan, light magenta and yellow dots, as is shown in FIG. 7B, the nozzle opening arrays K, M and C that eject dark color inks of black, dark magenta and dark cyan constitute the first group, and nozzle opening arrays Y, m and c that eject light color inks of yellow, light magenta and light cyan constitute the second group. Further, the nozzle openings 2 of each nozzle opening array are formed by four print-pitches and the first group nozzle opening arrays are shifted from the second group nozzle opening arrays by two print-pitches. Therefore, in the same manner as previously described, the mixing of the inks used for the black, dark magenta and dark cyan dots with the inks used for the light cyan, light magenta and yellow dots can be prevented.

Figure 8:
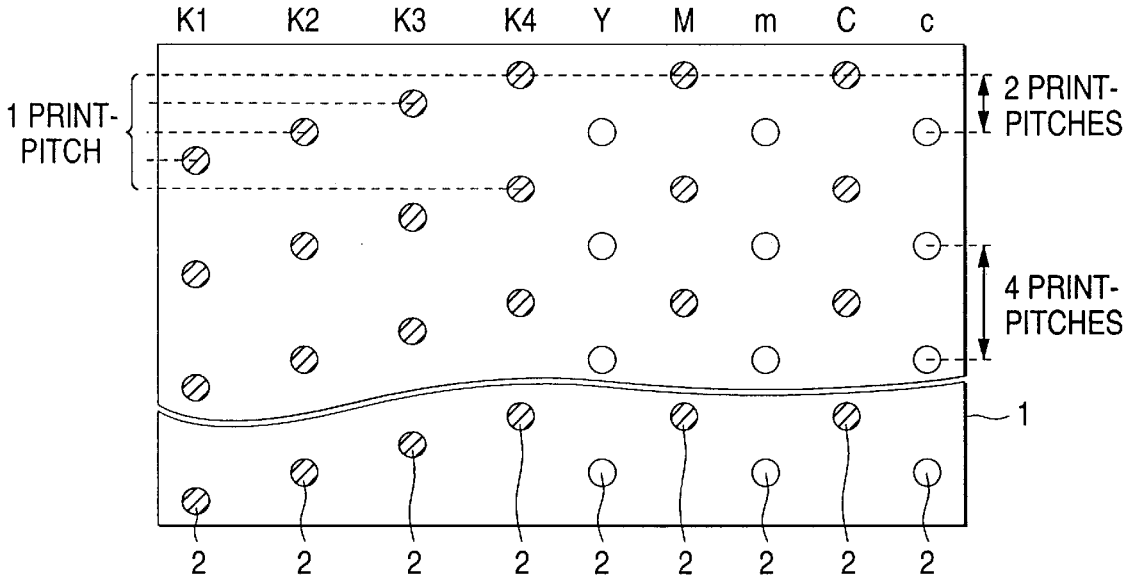
FIG. 8 is a diagram illustrating another arrangement of nozzle openings for the recording head of the present invention.

In the above embodiment, the nozzle openings 2 through which the individually colored inks are ejected are arranged at the same print-pitches. However, when text data are the main print data, as with a recording device used for clerical work, as is shown in FIG. 8 a plurality of nozzle opening arrays K1, K2, K3 and K4, which have nozzle openings arranged at constant print-pitches for the ejection of black ink droplets, are shifted away from each other one print-pitch in the sub-scanning direction. For text printing, all the nozzle opening arrays K1, K2, K3 and K4 are employed. For color printing, nozzle opening arrays for ejecting dark colored ink, i.e., nozzle opening arrays M, C and K4 in this embodiment, and nozzle opening arrays Y, m and c for ejecting light colored ink are employed to print text at a high dot density in order to ensure a high printing quality and a high printing speed. In addition, high quality printing of color data can be performed without light colored inks mixing with dark colored inks.

As is described above, since the colored inks are sorted into a plurality of groups and nozzle opening arrays are shifted two or more pitches, ink smudging can be substantially prevented. However, the order of ejection of ink droplets of different groups cannot be taken into consideration.

That is, in the example in FIG. 5, rasters for dots respectively represented by hatched ○, ⓧ, ◎ and ○ are scanned for printing. However, for one raster, dots represented by the hatched ○ are printed first, and for the other rasters, dots represented by ⓧ, ◎ or ○ are printed first.

Although the ink smudging at the color boundary can be prevented as previously described, when different ink colored dots are to be formed and overlapped at the same position to express a specific color (for example, when a green dot is formed by overlapping a cyan C dot and a yellow Y dot), the compositions of these inks differ, so that in the actual printing the hue (the color tone) and the particle appearance are changed depending on which ink dots are formed first (for expressing green dots, there is a method for forming cyan dots first and then yellow dots, or a method for forming yellow dots first and then cyan dots).

For this reason, in consonance with the background on which to print colored inks and the combination of color inks, nozzle openings of different colored inks must be arranged in the same group to always form dots in the same order.

Figure 9A:
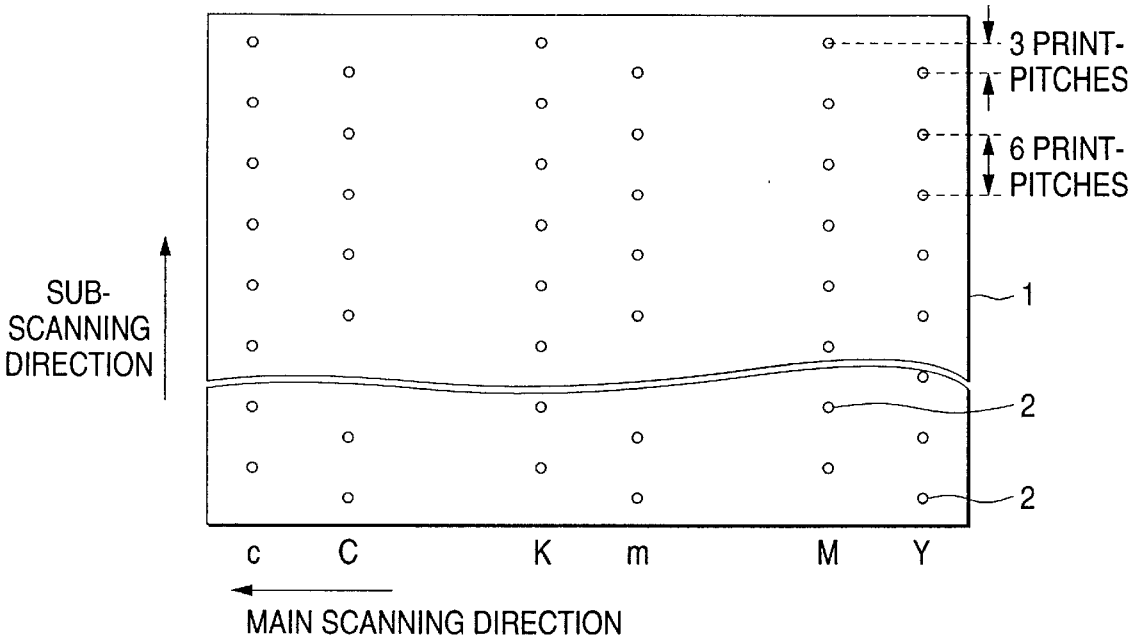
FIGS. 9A and 9B are diagrams illustrating additional example arrangements of nozzle openings for the recording head the present invention.

In FIG. 9A shows an example handling such a problem. Light cyan, dark cyan, black, light magenta, dark magenta and yellow nozzle opening arrays c, C, K, m, M and Y are located in the named order. The light cyan nozzle opening array c and the dark cyan nozzle opening array C are shifted away from each other three print-pitches, the black nozzle opening array K and the light magenta nozzle opening array m are shifted away from each other three print-pitches, and the dark magenta nozzle opening array M and the yellow nozzle opening array Y are shifted away from each other three print-pitches.

In this example, the cyan and yellow nozzle openings are located as the same group and the cyan dots are printed first.

Furthermore, the magenta and light cyan nozzle openings are located as the same group and the light-cyan dots are printed first. As a result, an increase in the particle appearance due to smudging is prevented, and black and yellow colors that tend to smudge are arranged as different groups to completely prevent them from being mixed.

Figure 9B:
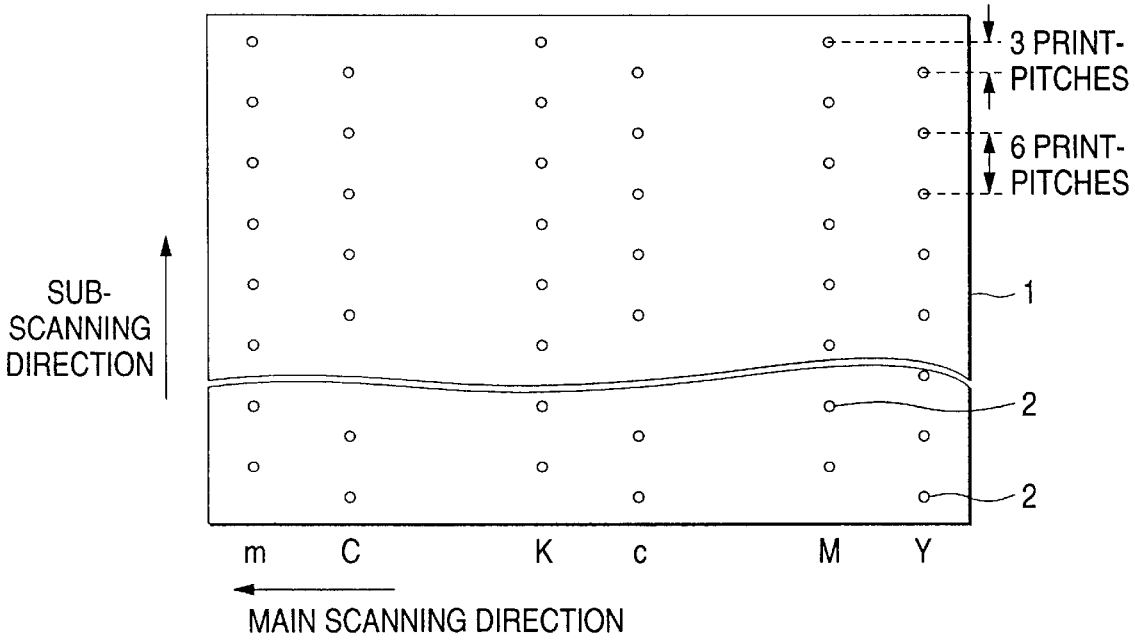
Figure 10A:
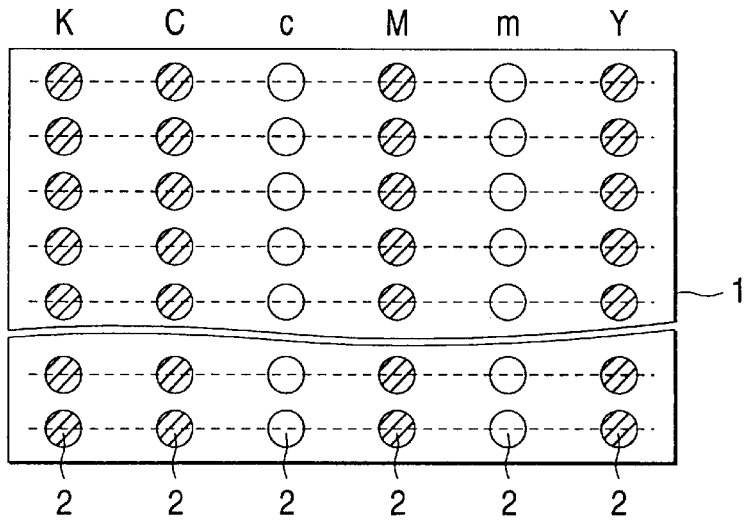
FIGS. 10A and 10B are diagrams illustrating arrangements of nozzle openings for a conventional recording head.
Figure 10B:
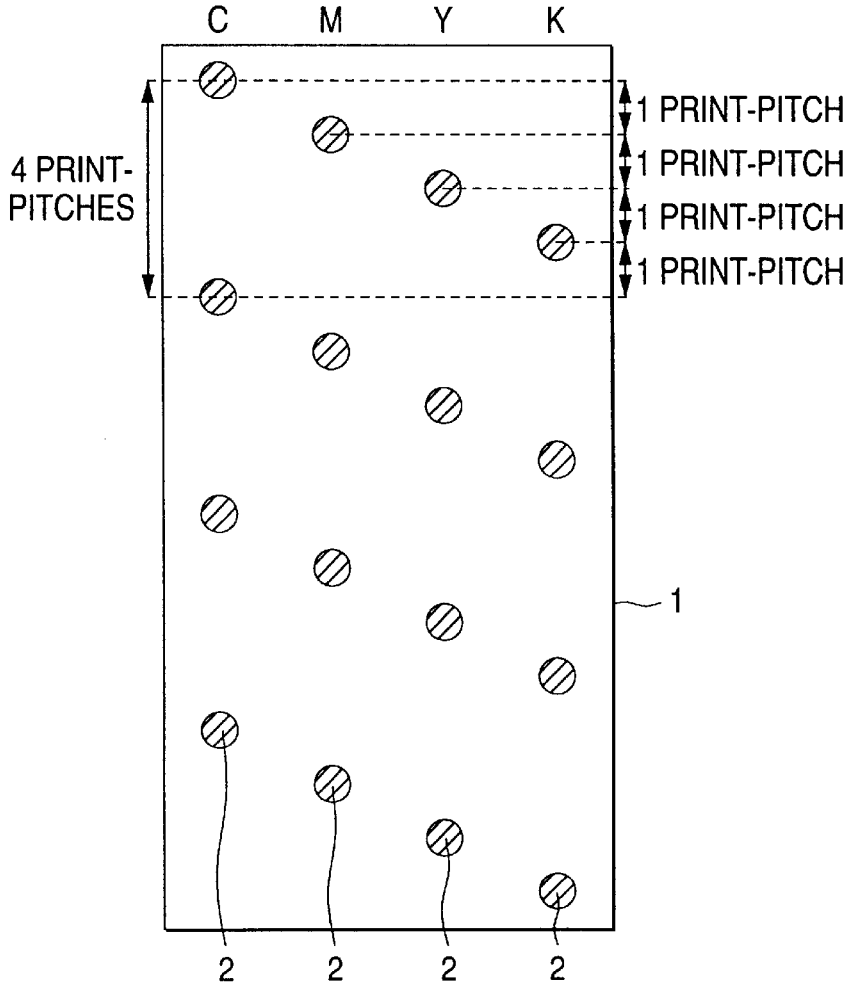

In the example shown in FIG. 9B, light magenta, dark cyan, black, light cyan, dark magenta and yellow nozzle opening arrays m, C, K, c, M and Y are arranged in the named order. And the light magenta nozzle opening array m and the dark cyan nozzle opening array C are shifted away from each other three print-pitches, the black nozzle opening array K and the light cyan nozzle opening array c are shifted away from each other three print-pitches, and the dark magenta nozzle opening array M and the yellow nozzle opening array Y are shifted each other by three print-pitches.

In this example, since the cyan, light cyan and yellow nozzle openings are located as the same group and the cyan and light cyan dots are printed first, so that the increase in the particle appearance due to smudging can be prevented, and black and yellow colors that tend to smudge are arranged as different groups to prevent them from being mixed.

As is described above, according to the present invention, the recording head is so designed that a plurality of nozzle openings for each of the nozzle opening arrays are arranged at intervals of at least four or more print-pitches in the sub-scanning direction, that the nozzle opening arrays are divided into at least two groups, that the nozzle opening arrays belonging to each of the groups are positioned along the same line in the main scanning direction, and that the groups are shifted away from each other at least two print-pitches in the sub-scanning direction, and thus, color data can be printed by an interlace system. Therefore, a recording medium can be fed at a constant distance, and ink dots whose colors may be changed due to color mixing can be printed at a time interval long enough to dry the ink, so that the mixing of colors, banding or the production blank areas can be prevented during printing, and high quality color printing can be provided.

What is claimed is:

1. An ink-jet printing apparatus that moves in a main scanning direction an ink-jet recording head in which a plurality of nozzle opening arrays, through which different color ink droplets are independently ejected, are arranged in said main scanning direction, and that feeds a recording medium in a sub-scanning direction when one scan is completed, said recording head comprising a plurality of nozzle openings for each of said nozzle opening arrays, wherein:

said nozzle openings are arranged at intervals of at least four or more print-pitches in said sub-scanning direction;

said nozzle opening arrays being subjected to ink droplets ejection in a single main scanning movement of the recording head are divided into at least two groups;

said nozzle openings arrays that belong to each of said groups being positioned along the same line in said main scanning direction;

said groups being shifted away from each other at least two print-pitches in said sub-scanning direction; and said recording head uses an interlaced system to print color data.

2. An ink-jet printing apparatus according to claim 1, wherein said at least two groups are a first group for black and a second group for cyan, magenta and yellow.

3. An ink-jet printing apparatus according to claim 1, wherein said at least two groups are a first group for black, a second group for cyan, a third group for magenta and a fourth group for yellow.

4. An ink-jet printing apparatus according to claim 1, wherein said at least two groups are a first group for black, dark cyan, dark magenta and yellow, and a second group for light cyan and light magenta.

5. An ink-jet printing apparatus according to claim 1, wherein said at least two groups are a first group for black, dark cyan and dark magenta, and a second group for yellow, light cyan and light magenta.

6. An ink-jet printing apparatus according to claim 1, wherein said at least two groups are a first group for black, dark magenta and light cyan, and a second group for dark cyan, yellow and light magenta.

7. An ink jet printing apparatus according to claim 6, wherein nozzles for jetting light cyan ink, dark cyan ink, black ink, light magenta ink, dark magenta ink and yellow ink are arranged in order in the main scanning direction.

8. An ink-jet printing apparatus according to claim 1, wherein said at least two groups are a first group for black, dark magenta and light magenta, and a second group for dark cyan, yellow and light cyan.

9. An ink printing apparatus according to claim 8, wherein nozzles for jetting light magenta ink, dark cyan ink, black ink, light cyan ink, dark magenta ink and yellow ink are arranged in order in the main scanning direction.

10. An ink-jet printing apparatus according to claim 1, wherein said nozzle openings for one of said arrays through which color ink for printing text data is ejected are arranged at intervals of one print-pitch.

11. An ink jet printing apparatus according to claim 1, wherein the number of nozzles in the subscanning direction and the print pitch interval between the nozzles in the subscanning direction are relatively prime.

12. An ink printing apparatus according to claim 1, wherein the nozzle opening arrays belonging to the different groups eject different colors of ink.

13. An ink printing apparatus according to claim 1, wherein the number of nozzles in the subscanning direction and each of the at least four or more print-pitches are relatively prime.

* * * * *